US006363735B1

(12) United States Patent
Bushnell et al.

(10) Patent No.: US 6,363,735 B1
(45) Date of Patent: Apr. 2, 2002

(54) AIR CONDITIONER CONDENSER ORIFICE MEMBER HAVING CONDENSATE SUCTION PORT

(75) Inventors: Peter R. Bushnell, Cazenovia; David M. Rockwell, Fayetteville, both of NY (US); Nestor Hernandez, Monterrey (MX)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/641,238

(22) Filed: Aug. 17, 2000

(51) Int. Cl.[7] ..... F25B 47/00

(52) U.S. Cl. ..... 62/280; 62/285; 62/288

(58) Field of Search ..... 62/280, 285, 288

(56) References Cited

U.S. PATENT DOCUMENTS

| | | | | | |
|---|---|---|---|---|---|
| 3,662,557 | A | * | 5/1972 | Morgan | 62/279 |
| 3,766,751 | A | * | 10/1973 | Ball | 62/280 |
| 3,797,269 | A | * | 3/1974 | De Jarlais | 62/280 |
| 4,067,206 | A | * | 1/1978 | Smith | 62/280 |
| 4,107,939 | A | * | 8/1978 | Bolton et al. | 62/89 |
| 4,793,148 | A | * | 12/1988 | Ikari et al. | 62/280 |
| 6,067,812 | A | * | 5/2000 | Bushnell et al. | 62/280 |
| 6,085,539 | A | * | 7/2000 | Meyer | 62/285 |

* cited by examiner

*Primary Examiner*—Henry Bennett
*Assistant Examiner*—Mark Shulman

(57) ABSTRACT

The present invention relates to an orifice member for the condenser fan of an air conditioning unit, which has a basepan and a partition which divides the air conditioning unit into an indoor section forwardly of the partition and an outdoor section rearwardly of the partition. The indoor section includes an evaporator coil, an evaporator fan and means for collecting condensate and directing the condensate to the basepan in the outdoor section. The outdoor section includes a condenser coil at the rear thereof, a rotatably driven condenser fan having a second side and a discharge side, the fan being located forwardly of the condenser coil. The orifice member defines a barrier between the suction and discharge side of the condenser fan and has a fan orifice opening forwardly of the fan to define a restricted air flow passage therethrough between the suction side at a generally low pressure and the discharge side at a generally high pressure. The condenser fan is an axial fan with blades having tips extending from the suction side to the discharge side. The fan includes an annular slinger surrounding and having a portion secured to the blade tips in the region extending from the suction side to the discharge side. The tips and the slinger are located entirely rearwardly of the orifice member. The fan orifice and the slinger cooperate to define a first narrow annular passage therebetween. The slinger defines a second narrow annular passage with the underlying portion of the basepan, which is configured to collect condensate therein. The orifice member has a wall section underlying the fan orifice opening. The fan orifice opening has an imaginary vertically extending centerline and the wall section has an opening therein centered upon the centerline, which fluidly communicates the region of the basepan forwardly of the wall with both the first and second annular passages. The fluid opening has a narrow lateral dimension at the lower end thereof and a larger lateral dimension at the upper end thereof.

4 Claims, 8 Drawing Sheets

AIR CONDITIONER CONDENSER ORIFICE MEMBER HAVING CONDENSATE SUCTION PORT

BACKGROUND OF THE INVENTION

The present invention relates to room air conditioners and is more specifically directed to the configuration of a condensate suction port provided in a condenser coil fan orifice member to facilitate delivery of condensate to a condenser fan having a condensate slinger.

In air conditioning systems, condensation normally collects on the evaporator coil, runs off and must be disposed off. In small packaged air conditioning units, such as room air conditioners or what are known as "packaged terminal air conditioners" (PTAC), it is common to direct the condensate through various passageways to the outdoor section of the air conditioner where the compressor, condenser coil and condenser fan are located. When the air conditioner has been in operation for some time, a pool of condensate will collect in the outdoor section of the basepan. Several ways are known for dealing with the collected condensate in order to improve condenser capacity and the energy efficiency rating (EER) of the air conditioning unit. One of these is provide a slinger arrangement associated with the condenser fan. In a typical slinger arrangement, a blow through propeller fan coil configuration is used and the condensate collects at a location where the fan structure causes the condensate to be splashed onto the condenser coil where it is evaporated, thereby providing cooling to the condenser.

U.S. Pat. No. 6,067,812, assigned to the assignee of the present invention, entitled "Condenser Fan With Condensate Slinger", describes a system having an axial condenser fan which has an annular slinger surrounding and having a portion secured to the blade tips of the condenser fan in a region extending from the suction side of the fan for at least a portion of the distance to the discharge side. A fixed shroud having an inlet orifice surrounds the fan and the slinger with the tips and the slinger being located entirely within the fixed shroud. The inlet orifice of the fixed shroud and the slinger coact to define a restricted passage extending between the suction side and the discharge side of the fan. The slinger includes means for contacting condensate collecting thereunder and being wetted thereby such that the collected condensate tends to adhere to the slinger. As a result, when the unit is operating and the fan and slinger rotate as a unit, a pressure differential across the fan acts on the collected condensate tending to cause the collected condensate to move towards and to be at a higher level towards the suction side and the slinger contacts the higher level of collected condensate and is wetted. Condensate adhering to the slinger is then slung by centrifugal force into air discharging from the fan blades.

With the above described system, an opening is provided in the fixed shroud underlying the fan inlet orifice to provide a path for condensate to pass into the region underlying the fan and slinger. It has been found that under some operating circumstances, condensate may not pass freely through such orifice and, accordingly, the slinger system is not allowed to operate as efficiently as contemplated.

SUMMARY OF THE INVENTION

The present invention relates to an orifice member for the condenser fan of an air conditioning unit, which has a basepan and a partition which divides the air conditioning unit into an indoor section forwardly of the partition and an outdoor section rearwardly of the partition. The indoor section includes an evaporator coil, an evaporator fan and means for collecting condensate and directing the condensate to the basepan in the outdoor section. The outdoor section includes a condenser coil at the rear thereof, a rotatably driven condenser fan having a second side and a discharge side, the fan being located forwardly of the condenser coil. The orifice member defines a barrier between the suction and discharge side of the condenser fan and has a fan orifice opening forwardly of the fan to define a restricted air flow passage therethrough between the suction side at a generally low pressure and the discharge side at a generally high pressure. The condenser fan is an axial fan with blades having tips extending from the suction side to the discharge side. The fan includes an annular slinger surrounding and having a portion secured to the blade tips in the region extending from the suction side to the discharge side. The tips and the slinger are located entirely rearwardly of the orifice member. The fan orifice and the slinger cooperate to define a first narrow annular passage therebetween. The slinger defines a second narrow annular passage with the underlying portion of the basepan, which is configured to collect condensate therein. The orifice member has a wall section underlying the fan orifice opening. The fan orifice opening has an imaginary vertically extending centerline and the wall section has an opening therein centered upon the centerline, which fluidly communicates the region of the basepan forwardly of the wall with both the first and second annular passages. The fluid opening has a narrow lateral dimension at the lower end thereof and a larger lateral dimension at the upper end thereof.

BRIEF DESCRIPTION OF THE DRAWINGS

The invention may be better understood and its objects and advantages will become apparent to those skilled in the art by reference to the accompanying drawings, in which.

DESCRIPTION OF THE PREFERRED EMBODIMENT

Figure 1:
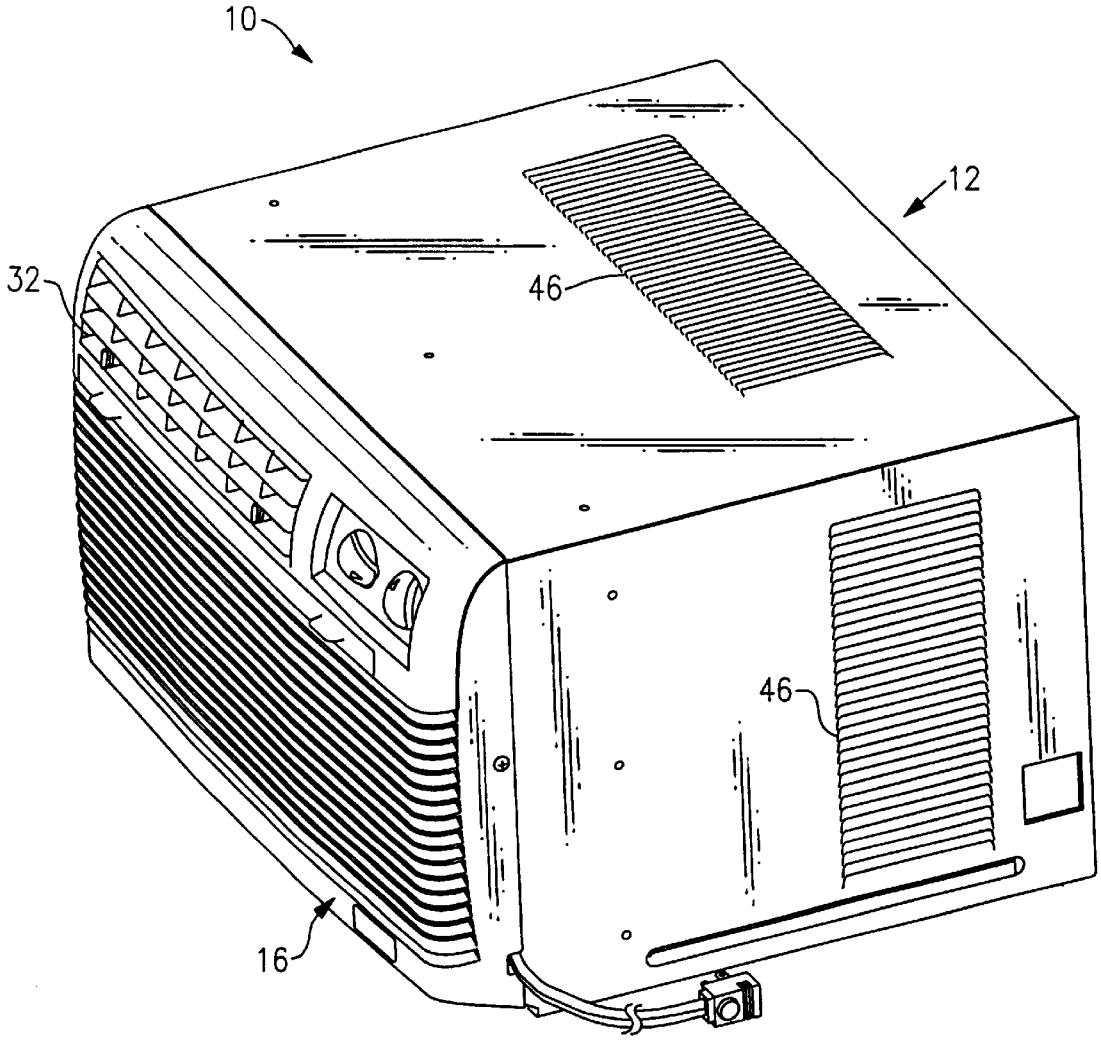
FIG. 1 is a perspective view of a room air conditioner, which embodies the features of this invention.
Figure 2:
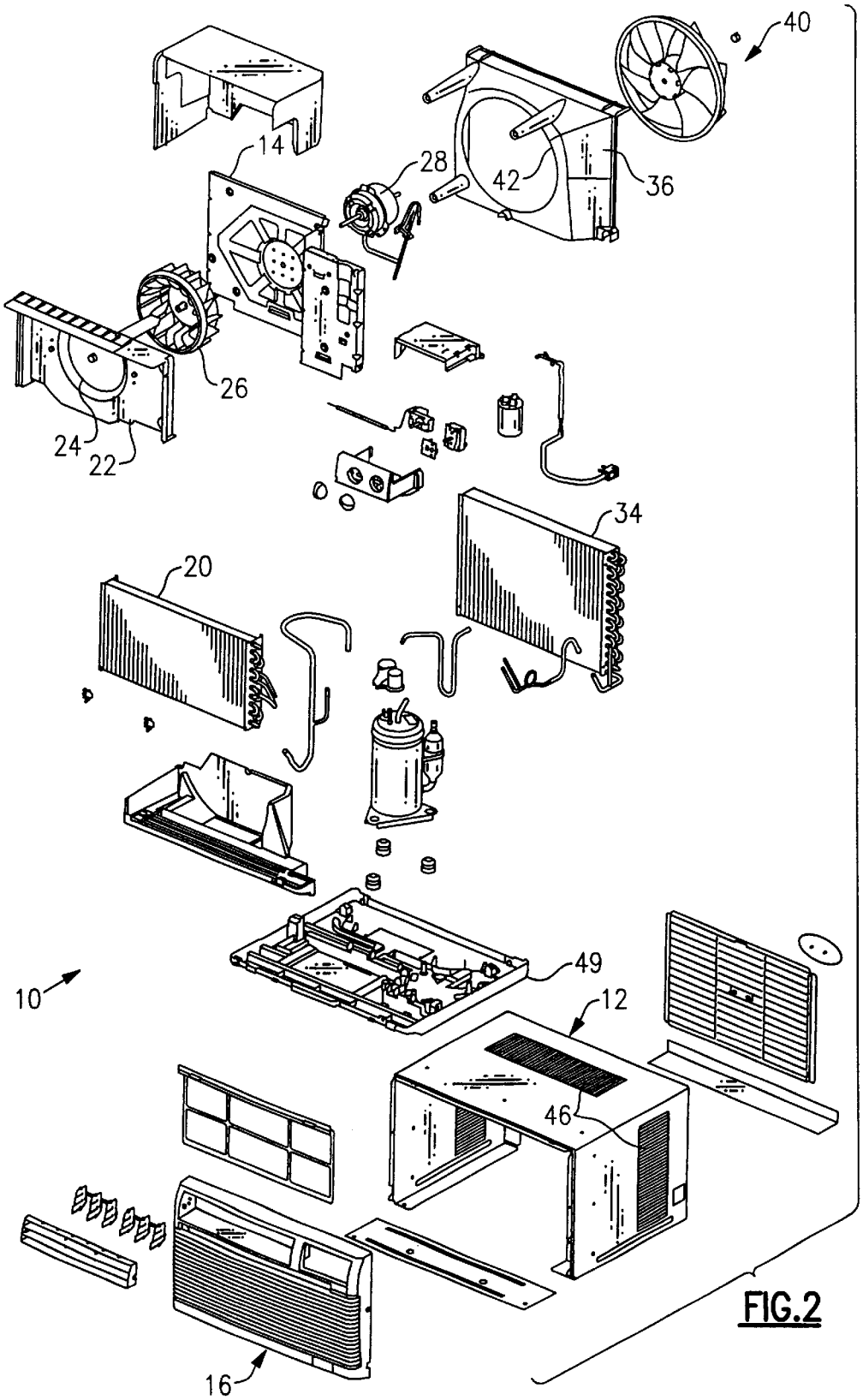
FIG. 2 is an exploded view of the air conditioner illustrated in FIG. 1.

In FIG. 1, the numeral 10 generally designates a room air conditioner employing the present invention. As is conventional, room air conditioner 10 has a housing 12 which may be located in a window or through the wall sleeve. Housing 12 is divided by partition or barrier 14 into an evaporator or inside section and a condenser or outside section which are each, in turn, divided into a suction and a discharge section relative to the fans located therein. Housing 12 includes inlet grille 16 which, when air conditioner 10 is installed, faces the interior of a room to be cooled.

Evaporator 20 is located directly behind inlet grille 16 and is mounted within shroud or housing 22. Housing 22 has a central rear opening 24 connected to the inlet of evaporator fan 26. Fan 26 is driven by motor 28 via shaft 30 which passes through and is sealingly supported by partition 14. Evaporator fan 26 discharges into the room to be cooled via louvers 32. Condenser 34 is located in housing 12 with its discharge side facing the outside. Fixed shroud 36 is connected to condenser 34 and the interior of housing 12 such that a fan chamber 38 containing the moving portion of condenser fan 40 is formed. Fixed shroud 36 includes an inlet orifice 42.

Fan 40 is of the axial, shrouded propeller type and is located entirely in the fan chamber 38 and is connected to motor 28 via shaft 30 such that both of fans 26 and 40 are commonly driven. Rotating shroud or suction slinger 44 is secured to the outer periphery of fan 40 on the inlet or suction side and extends toward inlet orifice 42 and coacts therewith to define the boundary between the suction side of fan 40 supplied via inlet grille 46 and the discharge side of condenser 34.

In operation, motor 28 commonly drives evaporator fan 26 and condenser fan 40. Evaporator fan 26 draws air from the room to be cooled with the air serially passing through inlet grille 16, evaporator 20 which causes the air to be cooled, fan 26 and louvers 32 back into the room. In cooling the air during its passage through evaporator 20, condensate commonly forms and falls into the bottom of the interior of partition 14 and housing 12 which include a path for causing the condensate to flow through the partition to a region 48 in a basepan 49 forward of the fixed shroud 26 where condensate collects. Condenser fan 40 draws outside air into the housing 12 via inlet grille 46 and the air serially passes through fan 40, and condenser 34 rejecting heat from the condenser.

As seen in FIGS. 3–5 and 7–14, a condensate suction port 50 is formed in a lower wall section 52 of the condenser shroud 36. The suction port 50 communicates the condensate collection region 48 forwardly of the fixed shroud 36 with the interior of the condenser fan chamber 38. As will be appreciated, the dynamics of the flow of air and condensate through the suction port are complex depending on the quantity of condensate present in the collection region 48.

Looking now at FIGS. 7–14 in detail, the inlet orifice 42 and rotating shroud/slinger 44 are axially and radially spaced such that when condenser fan 40 and its integral rotating shroud/slinger 44 are rotating, slinger 44 coacts with fixed shroud or inlet orifice 42 to establish a physical barrier in the nature of a narrow annular passage 54 separating the suction and discharge sides of condenser fan 40. A second narrow annular passage 56 of interest in understanding the air and flow dynamics in this region is defined between the lower end of the slinger 44 and the underlying wall 58 of the basepan 49.

Figure 3:
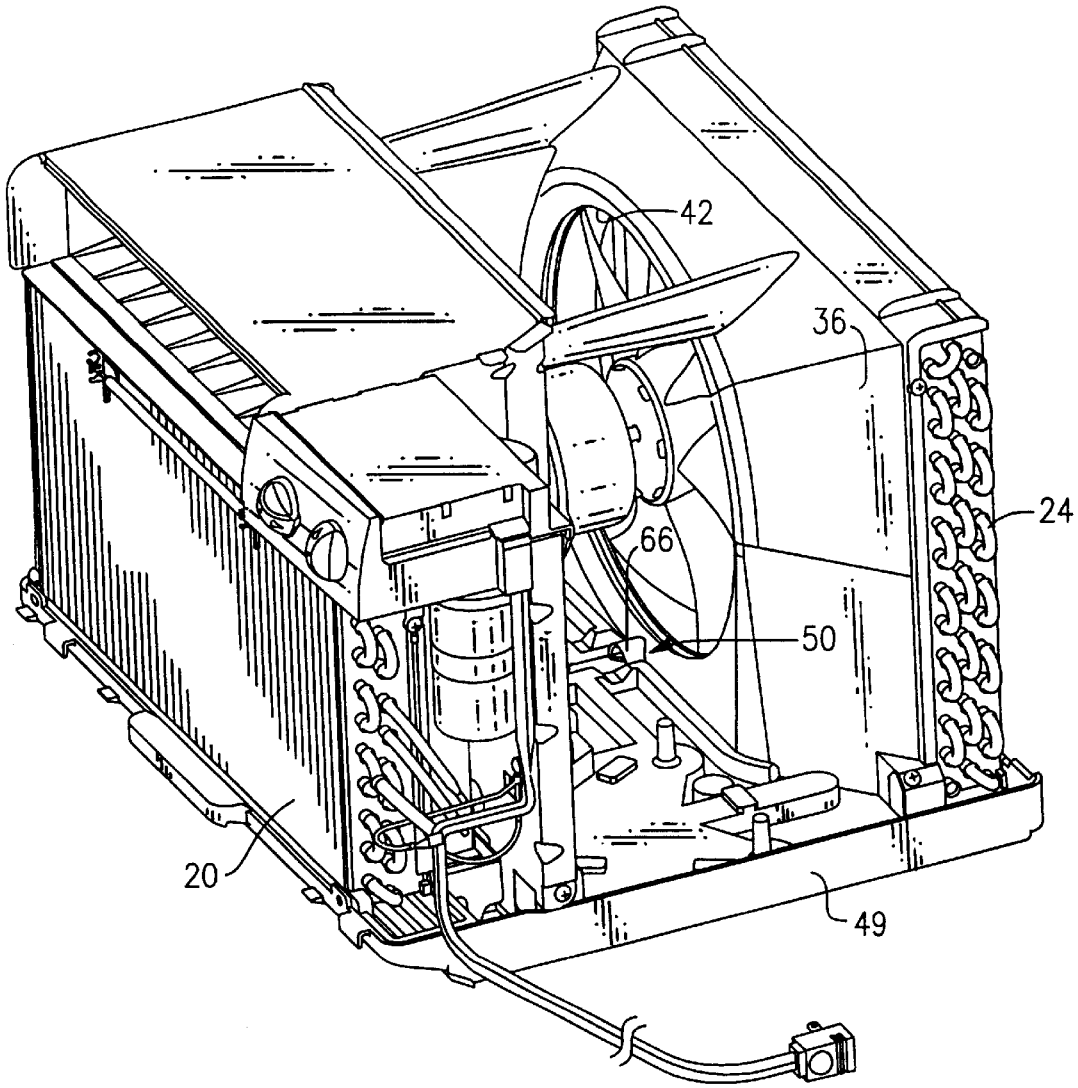
FIG. 3 is a perspective view of the air conditioner of FIG. 1 with the housing and front grille removed therefrom.
Figure 4:
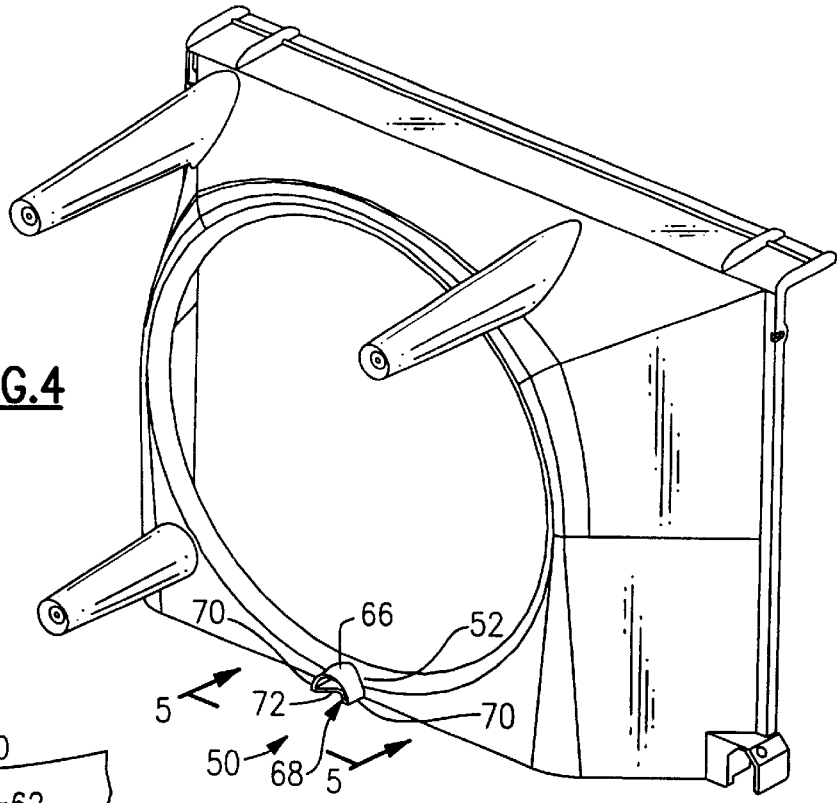
FIG. 4 is a perspective view of the condenser fan shroud of the air conditioner of FIG. 3.
Figure 5:
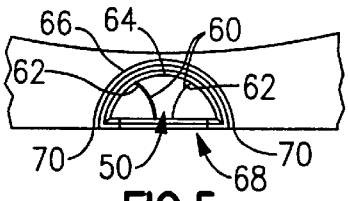
FIG. 5 is a view taken along the line 5—5 of FIG. 4.
Figure 6:
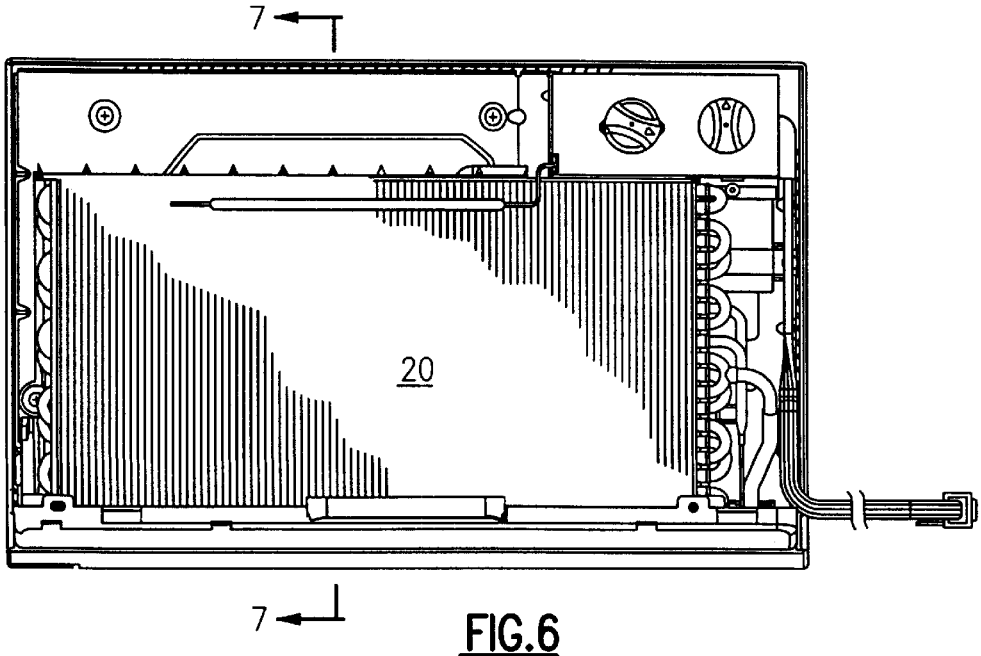
FIG. 6 is a front view of the air conditioner illustrated in FIG. 3.
Figure 7:
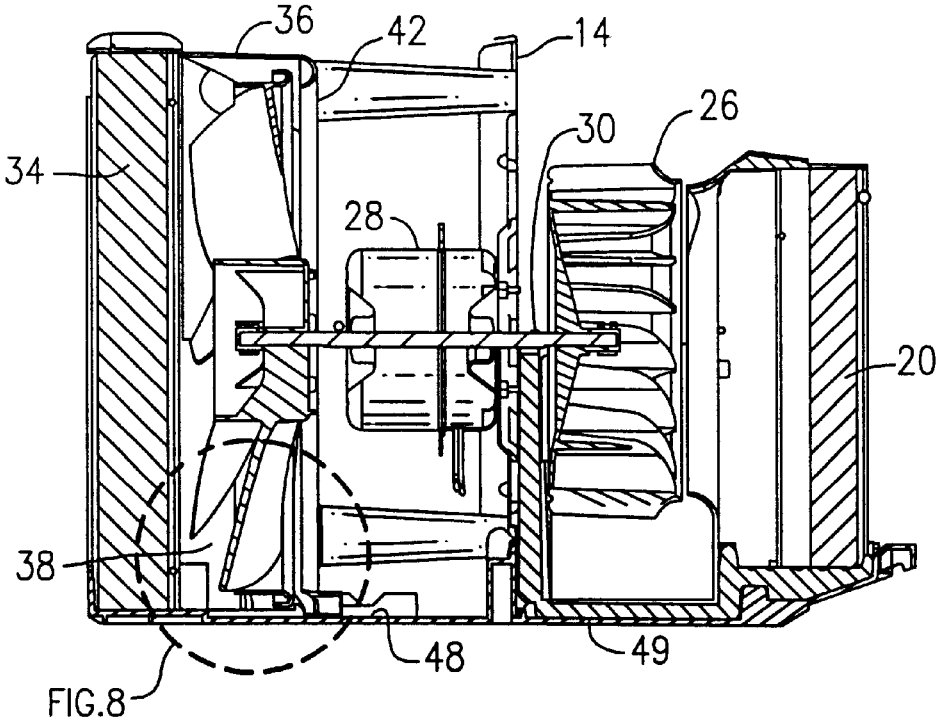
FIG. 7 is a view taken along the line 7—7 of FIG. 6.
Figure 8:
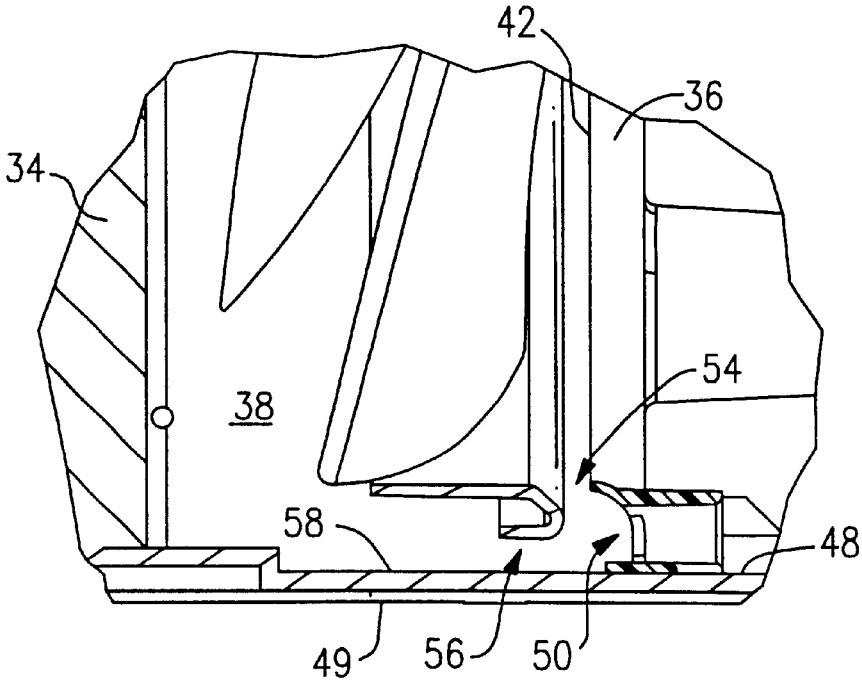
FIG. 8 is an enlarged view of the section identified as FIG. 8 in FIG. 7.

Looking now at FIGS. 4 and 5, the condensate suction port 50 is defined by opposing lateral side walls 60, which are closely spaced from one another at the lower ends thereof and which extend upwardly and diverge laterally outwardly from one another where they terminate at widely spaced upper ends 62. The upper ends of the side walls are interconnected by an arcuately extending top wall 64. As best seen in FIGS. 3, 4 and 5, an arcuate hood or wall structure 66 is formed in the lower wall section 52 containing the suction port 50 and extends forwardly therefrom and surrounds the arcuate top wall 64 and lateral side walls 60 of the suction port 50. A planar bottom wall 68 interconnects lower ends 70 of the arcuate hood. The bottom wall 68 has an inwardly directed V-shaped notch 72 formed therein to facilitate flow of conduit to the suction port 50. The bottom wall 68 extends for a distance under and rearwardly of the suction port 50.

With reference now to FIGS. 9–14, the dynamics of the flow of air and condensate through the suction port and into the region of the condenser fan 40 and slinger 44 will be discussed in detail. The flow arrows used in each of these drawing figures represent the flow of air in this region during operation of the air conditioner with the fan being rotatably driven by the motor 28. Water is represented by the region of speckled cross section and/or water droplets. It should be appreciated that the water of primary concern is condensate passing from the evaporator region into the condenser region of the air conditioner, although under conditions of heavy rainfall, a large quantity of water will be present in the basepan section of the outer part of the air conditioner. It should also be understood as the description of the various conditions continues that the condensate suction port 50 is located at the lower most point of a centerline extending through the axis of rotation of the condenser fan 40 and the conditions illustrated in FIGS. 9–14 represent the conditions at this point.

Figure 9:
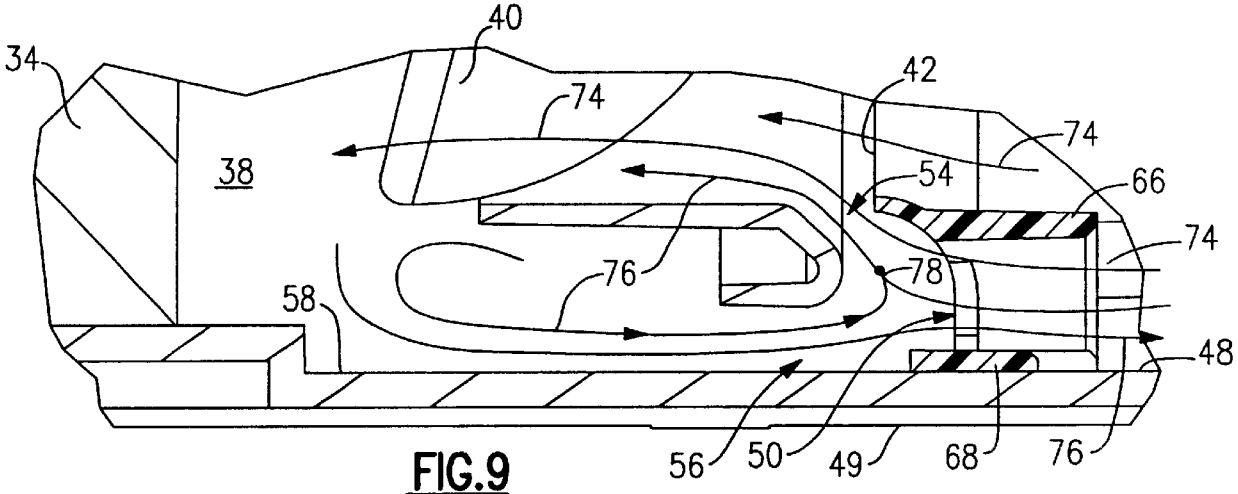
FIGS. 9–14 are enlarged views of the slinger and fluid orifice section illustrated in FIG. 8 during different conditions of operation.

FIG. 9 illustrates conditions under "dry" operation with the condenser fan 40 being operated at normal rotational speed. Under these conditions, arrows bearing reference numeral 74 represent air flow induced by the condenser fan through the inlet orifice 42 in the fixed shroud 36 and through the upper larger region of the condensate suction port 50. Arrows 76 represent a recirculation airflow driven by the pressure difference across the fan, i.e. from the high pressure at the discharge of the fan to the lower pressure region at the inlet of the fan. It will be noted that a portion of the recirculation flow 76 passes through the lower portion of the condensate suction port 50 while another portion combines with the air flow 74 induced by the condenser fan 40 and is drawn through the first narrow annular passage 54. Accordingly, under these conditions, air flow in the condensate suction port 50 includes a small outward flow at the lower end thereof and a larger inward flow at the upper end thereof. A point 78 illustrated as the intersection of the recirculation air flow and the primary air flow 74 may be defined as a stagnation point with respect to the direction of air flow at this point.

Figure 10:
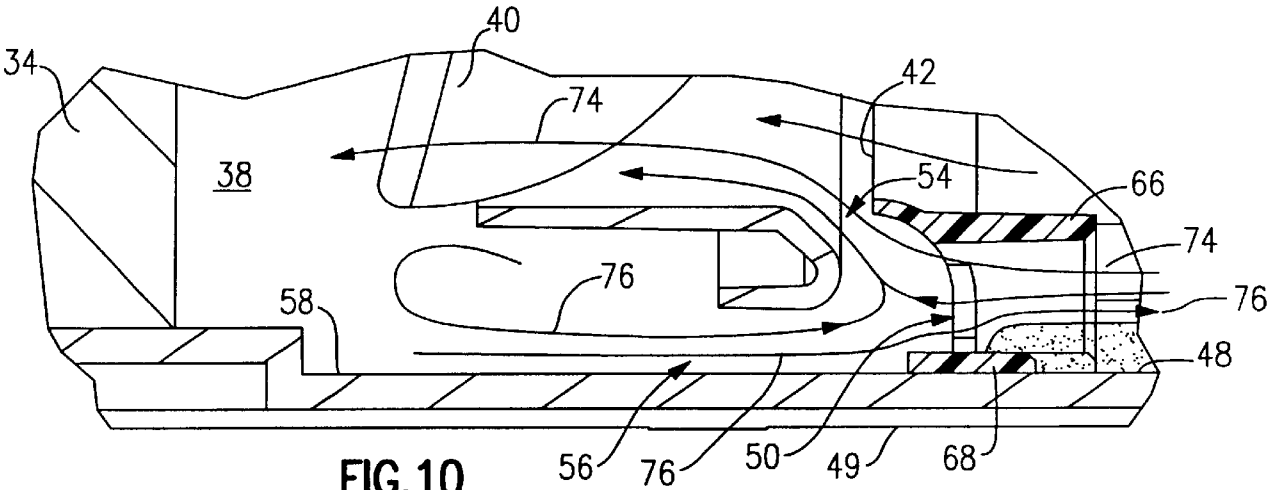

FIG. 10 illustrates conditions when a small amount of condensate has collected in the condensate collection region 48. Under these conditions, the outward flow at the lower end of the suction port 50 prevents the condensate from passing through the port and into the region underlying the slinger 44.

Figure 11:
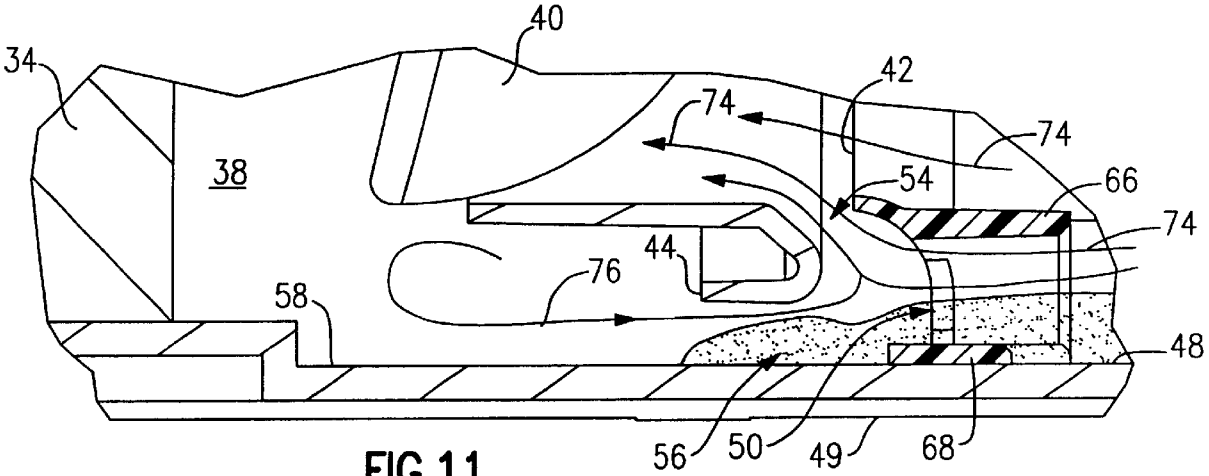

FIG. 11 represents conditions as additional water builds up and overcomes the resistance of the out flowing air though the suction port 50. This occurs relatively early with a relatively small amount of flow because of the relatively narrow width of the suction port 50 thus cutting off the back flow in the lower portion of the suction port with a relatively small amount of condensate. It should be noted that under these conditions the amount of condensate is still not sufficient for the lower end of the slinger 44 to dip into the water collected in the second narrow annular passage 56.

Figure 12:
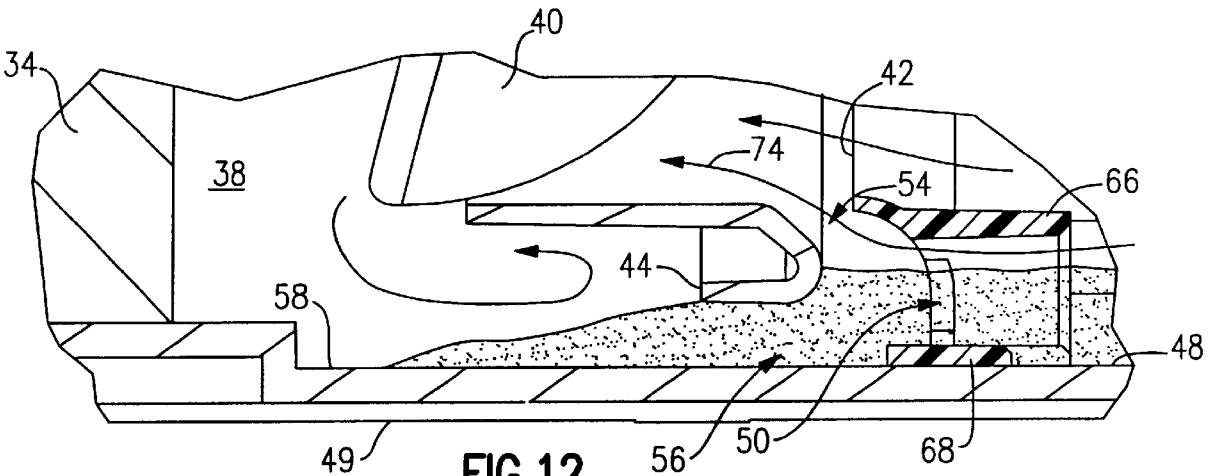

FIG. 12 represents conditions with the slinger 44 operating at nominal operating conditions. The water level has risen to a point where the wide section of the condensate suction port 50 and the primary flow of air 74 therethrough serves to draw condensate from the condensate collection region 48 through the port and into the second narrow annular passage 56 underlying the slinger 44 to thereby fully wet the slinger resulting in the slinger picking up and distributing condensate towards the condenser 34. It should be appreciated that under these conditions, the recirculation air flow 76 has been cut off by the immersion of the slinger 44 in the collected condensate.

Figure 13:
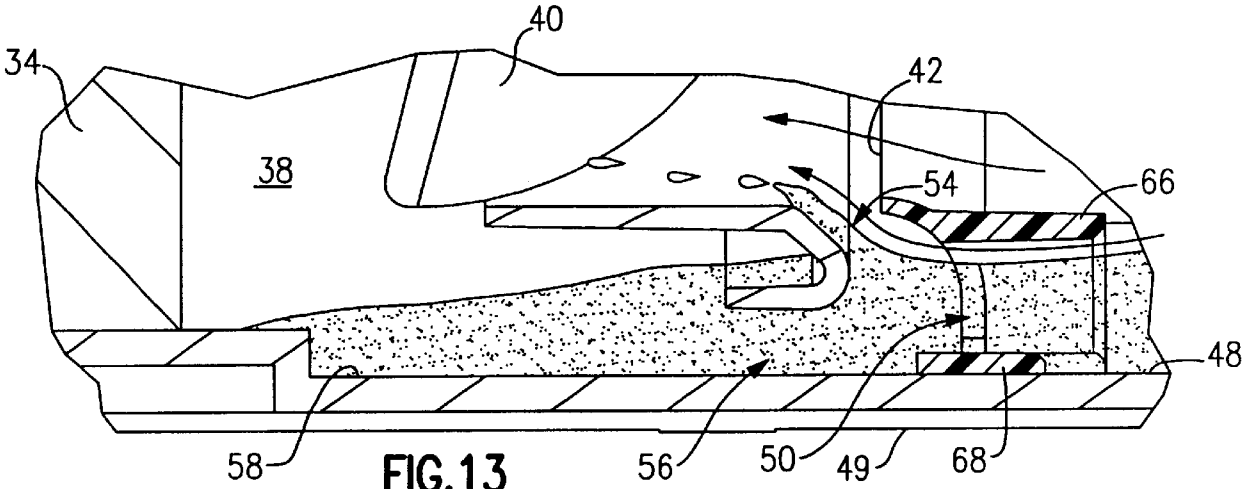

FIG. 13 represents conditions with a higher than nominal amount of condensate collected in the basepan. Under these conditions, a quantity of water enters into the first narrow annular passage 54 above the slinger 44 and into the fan.

Figure 14:
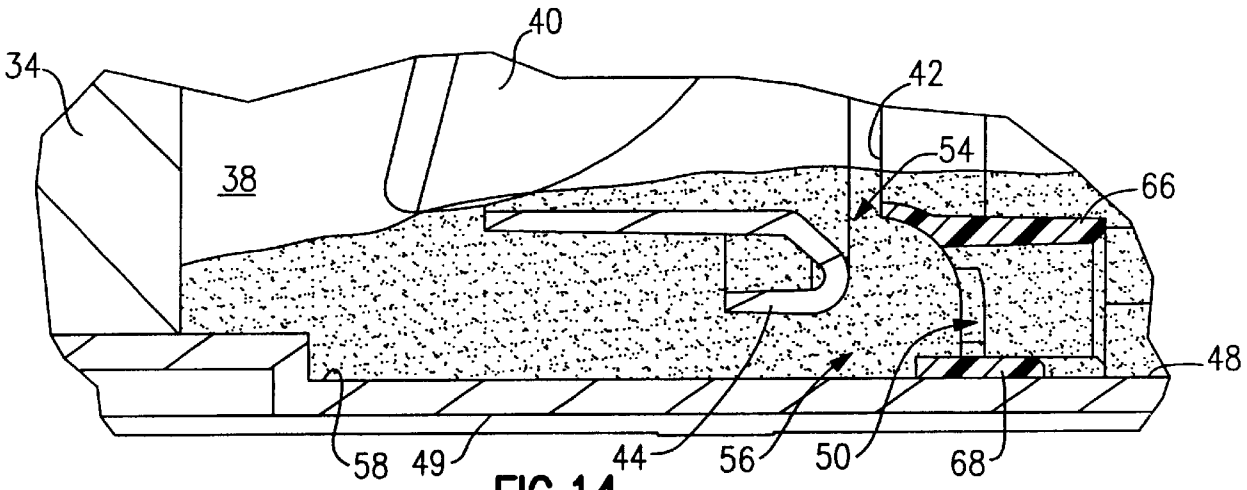

Finally, FIG. 14 illustrates massively flooded conditions with an excess of water which may be caused at extremely high humidity or high level of rain fall. Under these conditions, the slinger and the tips of the condenser fan 40 are immersed in the water and the beneficial effects of the slinger are not fully derived by the system.

Looking back at FIGS. 4, 5, 11 and 12, it should be appreciated that the transition to optimal slinger operation is facilitated by the extremely narrow width and accordingly cross section of the condenser suction port 50 at the lower end thereof. Further, the existence of the bottom wall 68 serves to block the passage of recirculating air flow outwardly through the suction port 50 during the stages approaching optimal operation of the slinger.

It should be appreciated that other shapes of the condenser suction port 50, such as, for example, an inverted triangle, will result in similar beneficial flow effects during operation of the system.

What is claimed is:

1. An orifice member for the condenser fan of an air conditioning unit, the air conditioning unit having a basepan, the basepan having a partition which divided the air conditioning unit into an indoor section forwardly of the partition and an outdoor section rearwardly of the partition, the indoor section including an evaporator coil, a rotatably driven evaporator fan, and the means for collecting condensate and directing the condensate to the basepan in the outdoor section, the outdoor section including a condenser coil at the rear thereof, a rotatably driven condenser fan having a suction side and a discharge side, the fan being located forwardly of the condenser coil, said orifice member defining a barrier between the suction side and the discharge side of the condenser fan and a having a fan orifice opening therein forwardly of the fan to define a restricted air flow passage therethrough between the suction side at a generally low pressure and the discharge side at a generally high pressure, said condenser fan being an axial fan with a plurality of blades having tips extending from said suction side to said discharge side, and annular slinger surrounding and having a portion secured to said blade tips in a region extending from said suction side for at least a portion of the distance to said discharge side, said tips and said slinger being located entirely rearwardly of said orifice member;

said fan orifice and said slinger cooperating to define a first narrow annular passage therebetween, and said slinger defining a second narrow annular passage with the underlying portion of said basepan being configured to collect condensate therein, wherein the improvement comprises:

said orifice member having wall section underlying said fan orifice opening, said fan orifice opening having an imaginary vertically extending centerline, said wall section having a through opening formed therein centered upon said centerline, said opening fluidly communicating the region of said basepan forwardly of said wall section with both of said first and second annular passages, said fluid opening having a narrow lateral dimension at the lower end thereof and a larger lateral dimension at the upper end thereof.

2. The orifice member of claim 1 wherein said wall section includes a barrier section underlying said lower end of said fluid opening.

3. The orifice member of claim 1 wherein said fluid opening is defined by opposing lateral side walls closely spaced from one another at the lower ends thereof and which extend upwardly and diverge laterally outwardly from one another where they each terminate at widely spaced upper ends, said upper ends of said side walls being interconnected by an arcuately extending top wall.

4. The orifice member of claim 3 including an arcuate wall extending forwardly from the forward side of said wall section, said arcuate wall surrounding said top wall and lateral side walls of said fluid opening, said arcuate wall having spaced apart lower ends terminating at the lower end of said wall section and further including a planar bottom wall interconnecting the lower ends of said lateral wall.

* * * * *